United States Patent [19]

Kelly

[11] 4,364,172

[45] Dec. 21, 1982

[54] METHOD OF FORMING AN ELECTRICAL CONNECTOR

[76] Inventor: Steven M. Kelly, 600 West at 900 North, Ligonier, Ind. 46767

[21] Appl. No.: 163,174

[22] Filed: Jun. 26, 1980

[51] Int. Cl.[3] ..... H01R 43/00

[52] U.S. Cl. ..... 29/858; 29/863

[58] Field of Search ..... 29/858, 828, 857; 174/75 R, 77 R; 339/101, 102 R, 143 R, 218 R, 102 L

[56] References Cited

U.S. PATENT DOCUMENTS

| | | | |
|---|---|---|---|
| 2,701,867 | 2/1955 | Obenschain et al. | 339/102 R |
| 2,876,274 | 3/1959 | Cole et al. | 339/143 R |
| 3,542,663 | 11/1970 | Alewitz | 174/75 R X |
| 3,600,499 | 8/1971 | Hibbs | 29/828 X |
| 3,744,128 | 7/1973 | Fisher et al. | 29/858 |
| 3,978,581 | 9/1976 | Miura | 29/858 |
| 4,025,145 | 5/1977 | Shaffer et al. | 29/857 X |
| 4,152,538 | 5/1979 | Gassinger et al. | 29/857 X |

*Primary Examiner*—Carl E. Hall
*Assistant Examiner*—Carl J. Arbes
*Attorney, Agent, or Firm*—Albert L. Jeffers; Roger M. Rickert

[57] ABSTRACT

An electrical connector for a multiconductor cable is disclosed where the connector is formed at one end of a conductor disposed in a flexible metal conduit by providing the conductor with a terminal at the one end and placing at least a portion of the terminal along with portions of the conductor and the flexible metal conduit in a connector forming cavity to thereafter form insulating material about the terminal, conductor and flexible metal conduit portions in the cavity. By this technique the insulating material may be made to conform to the exterior of the flexible metal conduit portion and also to conform to a section of the interior of that conduit along a length extending beyond the cavity thereby providing an extremely rugged and serviceable connector arrangement. The terminal may be simply crimped about the conductor near the end thereof and somewhat beyond the end of the flexible metal conduit and the insulating material formed by an injection molding technique.

7 Claims, 3 Drawing Figures

METHOD OF FORMING AN ELECTRICAL CONNECTOR

BACKGROUND OF THE INVENTION

The present invention relates generally to electrical connectors and more particularly to such connectors for flexible metal conduit enclosed conductors. Even more specifically, the present invention relates to a process of fabricating such connectors at ends of multiconductor cable having a protective sheath.

It is well known in the prior art to mold connectors on insulated conductors with such processes being typified by the conventional extension cord fabricating techniques. Flexible metal conduit or other cables with protective sheaths, however, are normally provided with connector terminals by passing the sheathed cable through some type of screw operated clamp for securely gripping the sheath with the conductors extending beyond that clamp and into a metal terminal box or otherwise connected to terminals which are in turn securely associated with that clamp.

It would be highly desirable due to the manufacturing economies to employ molded connectors on sheathed cables, however, the use of such molded connectors with relatively rigid sheathed cables appears ill-fated due to the substantial stress imposed on the junction between the sheath and connector during normal use. This stress is, of course, far greater than experienced by, for example the connector at an end of a conventional extension cord because of the substantial differences in flexibility between the conventional extension cord and relatively rigid sheathed cables.

SUMMARY OF THE INVENTION

Among the several objects of the present invention may be noted the provision of a connector which is securely fastened to flexible metal conduit in which its conductors lie; the provision of a unique connector fabricating technique for quickly and economically forming a connector at the end of a sheathed multiconductor cable; the provision of an injection molding technique for forming insulating material about flexible metal conduit to provide a connector at an end thereof; and the provision of an easily and economically fabricated cable connector. These as well as other objects and advantageous features of the present invention will be in part apparent and in part pointed out hereinafter.

In general, electrical connectors are fabricated at ends of sheathed multiconductor cable by providing terminals electrically connected to the conductors near the conductor ends and beyond an end of the protective sheath and supporting those terminals and the protective sheath with portions of each lying within a connector forming cavity. The cavity is then at least partially filled with a flowable insulating material and that material solidified to form a completed connector with the sheathed cable securely gripped by the connector and extending from one end thereof and with the terminals accessible from the opposite end thereof.

Also in general, and in one form of the invention, an electrical connector is formed at one end of a conductor disposed in a flexible metal conduit by first providing the conductor with a terminal at the one end, then placing at least a portion of that terminal along with a portion of the conductor and a portion of the flexible metal conduit in a connector forming cavity and forming insulating material about the terminal, conductor and flexible metal conduit portions in the cavity. Preferably, the insulating material conforms to the exterior of the flexible metal conduit portion in the cavity and flows into the interior of the flexible metal conduit for a short distance beyond the cavity to further strengthen the junction between the conduit and the connector.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
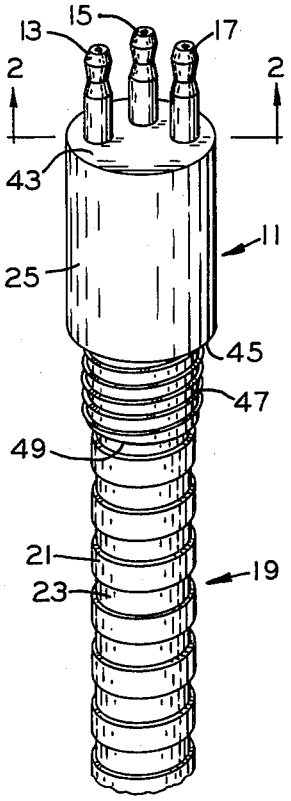
FIG. 1 is a perspective view of a section of sheathed multiconductor cable having a connector according to the present invention on one end thereof.
Figure 2:
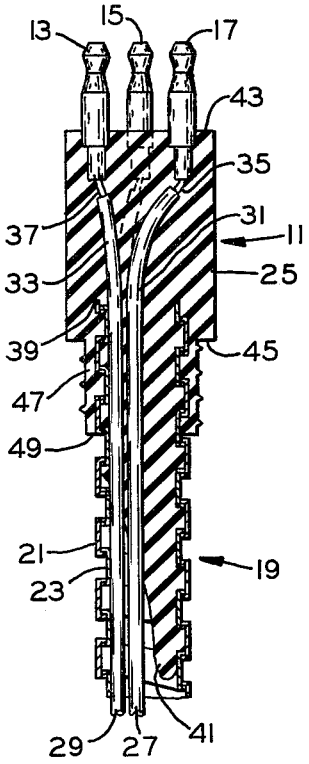
FIG. 2 is a view along section line 2—2 of FIG. 1.

Referring first to FIG. 1, there is illustrated an electrical connector 11 at one end of a flexible metal conduit 19 in which a plurality of conductors are disposed with those conductors being provided with terminals 13, 15 and 17. The flexible metal conduit 19 functions as a protective sheath for the conductors and is of conventional construction having a helical ridge 21 and trough 23 outer surface and a similar helical inner surface as seen in FIG. 2. The electrical connector 11 may be of any convenient external configuration and is here illustrated as a simple cylindrical insulating portion 25 having the terminals 13, 15 and 17 extending from one end surface thereof while the protective sheath 19 extends from the opposite end surface thereof.

In FIG. 2, the flexible metal conduit or sheath 19 is seen to contain multiple conductors such as 27 and 29, with each conductor having an insulating layer such as 31 and 33 and an exposed or insulation free conductor section such as 35 and 37 near the ends of the conductors to which the several terminals may be attached as by soldering or crimping. Insulating layers may, of course, be common to one or more of the conductors as is known in the art.

The conductors extend beyond end 39 of the cable sheath 19 to be exposed for easy access to remove the insulating layers and crimp or solder the exposed conductor sections such as 35 and 37 to the terminals. The insulating material extends in the opposite direction beyond end 39 outside the cable sheath to conform to the outside thereof and to securely grip the sheath exterior along a distance at least as great as the pitch of the helix and preferably further. Thus, as illustrated, the insulating material conforms to the sheath with insulating material filling the trough of the helix for an axial distance just slightly more than twice the pitch of the helix. The insulating material also extends into the sheath interior to conform to and grip the interior helical ridge and trough pattern for a distance greater than the corresponding exterior insulating surface. Thus, the insulating material is illustrated in FIG. 2 as extending upwardly at 41 to reduce flexing of the metal conduit close to the junction of the conduit and connector. The insulating material within the conduit may conform to all of or only a portion of the conduit interior and still accomplish the function of securely fastening the connector to the conduit and stiffening or preventing flexing of the conduit near the junction of the conduit and connector.

The cavity for forming the connector 11 may take several forms and while not illustrated its configuration for a given connector configuration is rather easily understood. For the illustrated cylindrical connector configuration, the cavity may be a generally cylindrical injection mold cavity having openings at one end for supporting the terminals 13, 15 and 17 with that one cavity end defining the surface 43 of the connector. The sheathed cable passes into the cavity from the end opposite the end defining surface 43 and that opposite end may define the annular surface 45 or may be undercut somewhat to allow insulating material to extend into the region 47 terminating at the end surface 49 to better grip the cable exterior. In either case, the connector forming cavity supports the terminals and conductor sheath so that portions of each lie within the connector forming cavity so that insulating material may be formed about the terminal, conductor and flexible metal conduit portions in the cavity either by simply pouring a flowable insulating material into that cavity or by providing a substantially closed cavity for injection molding purposes.

Figure 3:
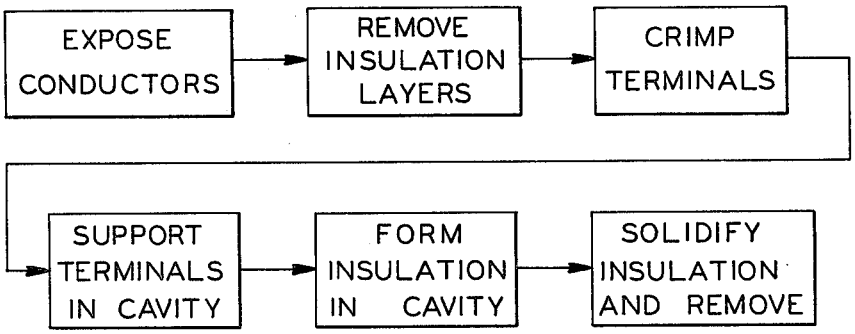
FIG. 3 is a simplified flowchart illustrative of the steps performed in forming connectors for conductor containing metal conduit.

The process of fabricating electrical connectors at ends of multiconductor cable having a protective sheath, such as the illustrated flexible metal conduit, may be summarized by referring to FIG. 3. The insulated conductors are first exposed so as to extend beyond the end 39 of the metal conduit either by sliding those conductors relative to the conduit or by cutting off a section of conduit, as desired. The insulating layers on the individual conductors are next removed by any of several known wire stripping processes and the individual terminals crimped or soldered to the insulation free conductor ends. Terminal crimping procedures where a portion of the terminal pierces the conductor insulating layer so that no separate conductor stripping is required may also be employed.

The terminals and conductor sheaths are next positioned so that portions of each lie within the connector forming cavity and that cavity is at least partially filled with a flowable insulating material and that insulating material solidified to form the completed connector with the sheathed cable extending from one end thereof and with the terminals accessible from the opposite end. In the event that the step of filling the cavity is performed by injection molding techniques, the insulating material is in a plastic rather than a liquid state but is still considered to be flowable and some solidification occurs prior to the removal of the completed connector from the mold cavity.

From the foregoing it is now apparent that a novel method of fabricating electrical connectors at ends of sheathed multiconductor cable has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. The method of forming an electrical connector at one end of a conductor disposed in a flexible metal conduit comprising the steps of:

providing the conductor with a terminal at the one end;

placing at least a portion of the terminal, a portion of the conductor, and a portion of the flexible metal conduit in a connector forming cavity so that the conduit and terminal extend in opposite directions from opposed sides of the cavity; and forming an insulating material about the terminal, conductor, and flexible metal conduit portions in the cavity to conform the insulating material to the exterior of the flexible metal conduit portion in the cavity with insulating material flowing into the interior of the flexible metal conduit and beyond the cavity.

2. The method of claim 1 wherein a plurality of individual insulated conductors are disposed in the flexible metal conduit and each of the plurality of conductors is provided with a terminal.

3. The method of claim 1 wherein the connector forming cavity is an enclosed cavity, the step of forming comprising injection molding the insulating material in the enclosed cavity to form an insulated portion of the connector.

4. The method of claim 1 wherein the conductor is provided with a terminal by crimping the terminal about the conductor near the conductor end and beyond an end of the flexible metal conduit.

5. The process of fabricating electrical connectors at ends of multiconductor cable having a protective sheath in the form of a flexible metal conduit having a helical ridge and trough outer surface comprising the steps of:

providing terminals electrically connected to the conductors near the conductor ends and beyond an end of the protective sheath;

supporting the terminals and protective sheath so that portions of each lie within a connector forming cavity;

filling at least part of the connector forming cavity with a flowable insulating material to conform the insulating material to the sheath outer surface along a distance at least as great as the pitch of the helix to securely grip the sheath exterior and allowing said insulating material to flow into the interior of said protective sheath and beyond the cavity; and solidifying the insulating material to form a completed connector with the sheathed cable extending from one end thereof and with the terminals accessible from the opposite end thereof.

6. The process of claim 5 wherein the connector forming cavity is an enclosed cavity, the step of filling comprising injection molding the insulating material in the enclosed cavity to form an insulated portion of the connector.

7. The process of claim 5 wherein each conductor is provided with a terminal by removing an individual insulating layer from the conductor near the conductor end and crimping the terminal about the conductor at least in the insulation free region of the conductor end.

* * * * *